US007780069B2

(12) United States Patent
Wilen

(10) Patent No.: US 7,780,069 B2
(45) Date of Patent: Aug. 24, 2010

(54) INSERT WITH A RETURN ENVELOPE

(75) Inventor: Richard Wilen, Deerfield Beach, FL (US)

(73) Assignee: Wilen Press, LC, Deerfield Beach, FL (US)

( * ) Notice: Subject to any disclaimer, the term of this patent is extended or adjusted under 35 U.S.C. 154(b) by 1325 days.

(21) Appl. No.: 10/838,847

(22) Filed: May 3, 2004

(65) Prior Publication Data

US 2005/0252956 A1 Nov. 17, 2005

(51) Int. Cl.
*B65D 27/06* (2006.01)
*B65D 27/00* (2006.01)
*B65D 27/08* (2006.01)

(52) U.S. Cl. ..... 229/301; 229/303; 229/70; 229/72

(58) Field of Classification Search ..... 229/301, 229/303, 304, 305, 307, 70, 72
See application file for complete search history.

(56) References Cited

U.S. PATENT DOCUMENTS

| | | | | |
|---|---|---|---|---|
| 691,767 | A | 1/1902 | Herndon | |
| 877,060 | A | 1/1908 | Douglass | |
| 2,016,063 | A | 10/1935 | White | |
| 2,062,776 | A * | 12/1936 | Berkowitz | 229/80 |
| 3,718,277 | A * | 2/1973 | Volkert | 229/301 |
| 3,858,792 | A * | 1/1975 | Volkert | 229/301 |
| 3,905,545 | A * | 9/1975 | Juszak et al. | 229/69 |
| 4,435,001 | A | 3/1984 | Mills et al. | |
| 4,775,095 | A | 10/1988 | Emmott | |
| 4,960,237 | A | 10/1990 | Bendel | |
| 5,064,115 | A * | 11/1991 | Steidinger | 229/304 |
| 5,429,298 | A * | 7/1995 | Chess | 229/305 |
| 5,487,566 | A | 1/1996 | Hedge, Jr. | |
| 6,019,280 | A | 2/2000 | Peterson | |
| 6,435,404 | B1 * | 8/2002 | Feick | 229/303 |
| 2002/0030093 | A1 * | 3/2002 | Kim | 229/302 |

* cited by examiner

*Primary Examiner*—Nathan J Newhouse
*Assistant Examiner*—Peter Helvey
(74) *Attorney, Agent, or Firm*—James David Johnson

(57) ABSTRACT

A mailer is disclosed for distributing advertisements and invoices. The mailer provides an envelope for returning the invoices and a buck slip for displaying advertisements and incentives. The buck slips and return envelope are attached to the mailer so that these papers are removed from the mailer simultaneously upon the opening of the mailer.

12 Claims, 6 Drawing Sheets

INSERT WITH A RETURN ENVELOPE

FIELD

The invention relates to a mailer assembly. More particularly, this invention relates to a mailer assembly for direct mail and/or promotional applications.

BACKGROUND

Known mailer assemblies for direct mail applications have been constructed in various ways to provide a medium for information, advertisements and invoices. In many cases, a direct mail mailer assembly is provided with a tear-off portion which is to be removed by a recipient. The tear-off portion may be in the form of a return envelope, an order form for purchasing magazines or merchandise, an invoice for goods or services rendered, or a form for returning needed information to the sender.

One example of a known mailer having a return envelope is U.S. Pat. No 2,016,063 to E. T. White. White discloses an envelope consisting of a single sheet of paper divided into four leafs. The front page on the first leaf contains a window for displaying a mailing address, and the front page on the fourth leaf contains the corresponding mailing address. To display the mailing address, the leafs are folded upon each other so that the front page of the fourth leaf is beneath the front page of the first leaf.

White includes a return envelope that is connected within the mailing envelope. To retrieve the return envelope, the mailer envelope must first be opened and the return envelope must then be torn off the mailer envelope.

The return address is found on the rear page of the forth leaf. To address the return envelope, the forth leaf must first be torn off of the third leaf, and the forth leaf must then be attached to the mailer envelope with the address displayed on the rear page of the forth leaf.

The extra steps, of removing the return envelope, removing the page having the return address, and combining the two, will likely dissuade a recipient from mailing the return envelope. Accordingly, White fails to teach a return mailer that is pre-assembled for the user and that detaches from the mailer upon the opening of the mailer.

Another prior art envelope is U.S. Pat. No. 6,019,280 to Peterson. Peterson discloses a tri-fold mailer. The mailer has a return postcard that is integral to the second or third leaf of the mailer. To remove the return postcard, the envelope must first be opened and the return postcard must then be torn from the mailer. This aspect of Peterson is problematic because it required the recipient to take further steps to remove the return postcard. Accordingly, Peterson fails to teach a mailer having a return mailer that is automatically detached from the mailer upon the opening of the mailer.

Peterson also teaches advertising buck slips, where the buck slips are loosely placed within the mailer prior to mailing to the recipient. The leafs are placed within the center of the mailer and the mailer is sealed about all four edges to secure the advertisements. If any of the sides of the mailer open in transit, then the advertisements would fall out. Further, sealing each edge of the mailer requires more glue than only sealing, for example, the top edge of the mailer with glue, and creating a seal on the bottom edge by folding the mailer leafs.

Peterson fails to teach a mailer having buck slip advertisements that are attached to the mailer before reaching the recipient and automatically detach from the mailer upon the opening of the mailer. With the advertisements secured to the mailer in transit, the sides of the mailer would not need sealing.

Another mailer with a return envelope is disclosed in U.S. Pat. No. 4,960,237 to Bendel. Bendel discloses a multi-ply outgoing mailer, where each sheet is the same size as each other sheet and each sheet is adhered to each consecutive sheet. In Bendel, the return envelope is retrieved from the mailer by opening the mailer and tearing the sheet or sheets with the return envelope from the remainder of the mailer. The sheets that comprise the return envelope are then folded about fold lines to create the form of the return envelope.

The problem with Bendel is that the user is required to take a series of steps before the return envelope can be used, including opening the envelope, separating the return envelope from the mailer, and forming the return envelope from the separated sheet. These steps would discourage the user from utilizing the return envelope. Accordingly, Bendel fails to teach a return envelope that is formed prior to reaching the recipient and removed from the mailer upon the opening of the mailer.

One prior art article for disseminating advertisements, albeit not a mailer, is U.S. Pat. No. 5,487,566 to Hedge, Jr. Hedge discloses two coupon pouches, each having a cover leaf that is capable of closing upon the pouch to form an envelope for holding coupons. Hedge also discloses a first and second leaf, each leaf has an internal and external edge. The first and second leafs are connected to each other on the respective internal edges, and each leaf is connected to a respective coupon pouch on the respective external edge. The first and second leafs contain bi-fold advertisements, where the advertisements are glued to each leaf. A recipient can selectively remove each bi-fold advertisement from each leaf.

After the recipient in Hedge receives the pouch, the recipient must tear away both the first and second leaf, which separates the pouches from each other. At this point, the recipient must tear away each bi-fold advertisement from each leaf. Only after these series of tears does the recipient have the free coupons and the pouches for holding coupons. Accordingly, Hedge fails to teach a pouch where a single tear frees each pouch component, including an attached pouch and bi-fold advertisements associated with the pouch assembly.

SUMMARY

A mailer is disclosed for distributing advertisements and invoices. The mailer provides an envelope for returning the invoices and a buck slip for displaying advertisements and incentives. The buck slips and return envelope are attached to the mailer so that these papers are removed from the mailer simultaneously upon the opening of the mailer.

BRIEF DESCRIPTION OF THE FIGURES

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DESCRIPTION OF THE EMBODIMENTS

A mailer 1 is disclosed (FIG. 1) for distributing advertisements and invoices. The mailer provides an envelope 36 for returning the invoices (FIG. 5) and a buck slip 53 (FIG. 6) for displaying advertisements and incentives. The buck slip 53 and return envelope 36 are attached to the mailer 1 so that these papers are removed from the mailer 1 simultaneously upon the opening of the mailer 1.

Figure 3:
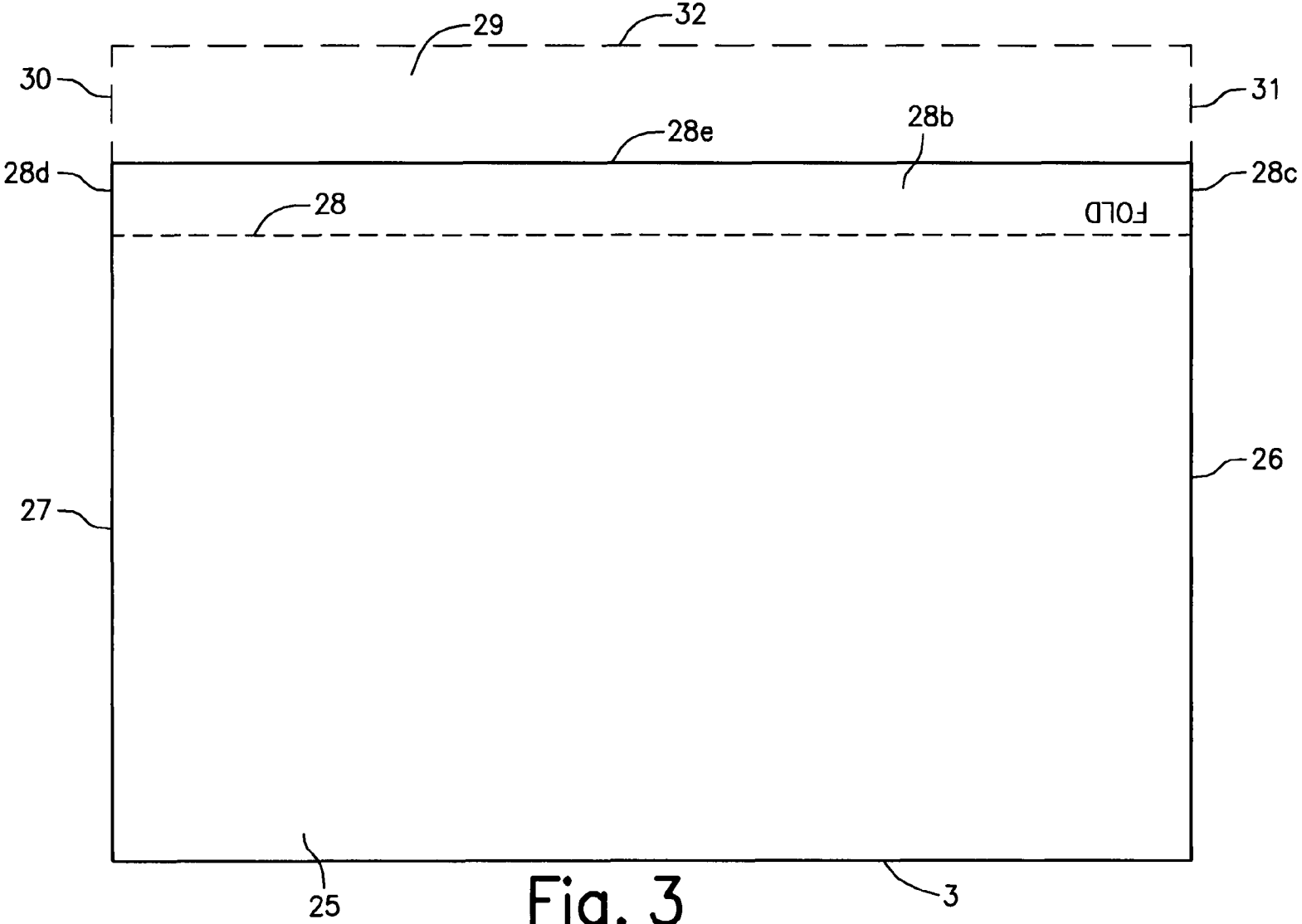
FIG. 3 is a rear view of a rear leaf of the mailer.

More specifically, the mailer 1 has a front face 2 (FIG. 1) and a rear face 25 (FIG. 3). The front face 1 and the rear face 25 (FIG. 1) are a continuous sheet folded at a bottom edge 3. The mailer 1 (FIG. 1) has first and second side edges 4, and 6 which are not sealed.

The front face 2 has a tear off section connected to the remainder of the front face 2 and mailer 1 via perforated lines 33 (FIG. 3). The return-envelope 36 (FIG. 5) has a tear off section that is attached to the tear off section 33 of the front face 2. The buck slip has a tear off section (FIG. 6) that is attached to the tear off section of the front face 2. Upon removing the tear off section of the front face 33, the front 2 and rear 25 faces of the mailer 1 are opened, and the return envelope 36 and buck slip 53 are released from the mailer 1.

Figure 1:
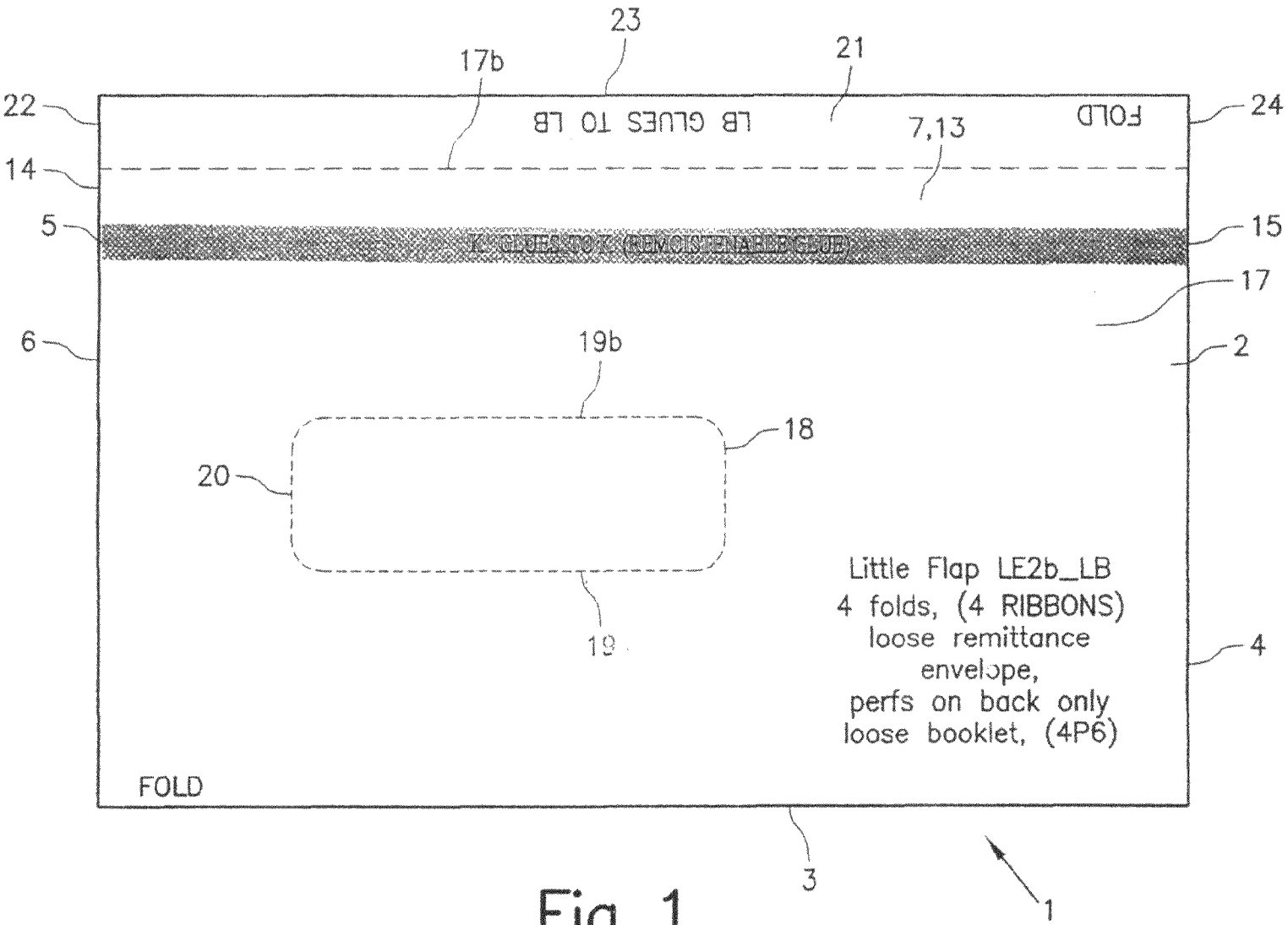
FIG. 1 is a front view of a front leaf and pocket of a mailer.

Turning now to FIG. 1, the mailer 1 is disclosed having a front leaf 2. The front leaf 2 is made of paper having a weight that enables the front leaf to withstand commonly applied stress during the processing and mailing of the mailer 1. The weight of the front leaf also allows the mailer 1 to maintain a first class mail rating when the mailer is filled with a return envelope and a buck slip.

The front leaf 2 forms the front face of a front pocket 17. The pocket 17 is used, for example, for mailing invoices to recipients. On the bottom and top of the pocket 17 are bottom edge 3. The bottom edge 3 is continuous with the pocket 17 and is shaped to fit against an adjacent edge of a return envelope and a buck slip stored with in the mailer 1. For example, the bottom edge 3 is straight and has a length of about seven and a quarter inches.

Opposing the bottom edge 3, on the pocket 17, is a top edge 5. The top edge 5 forms the top lip of the pocket 17. The shape of the top edge 5 is designed to accommodate a rectangular invoice having a long dimension being equal to or less than the dimension of the bottom edge 3. The top edge 5 is parallel to the bottom edge 3, the edge 5 is straight and has a length of about seven and a quarter inches.

On the side of the pocket 17 is first and second side edges 4 and 6. The first and second side edges 4 and 6 are both shaped to fit against an adjacent edge of a return envelope and buck slip stored within the mailer 1. For example, the first and second side edges 4 and 6 are parallel to each other, both are straight, and both are perpendicular to the bottom edge 3 and top edge 5.

The pocket 17 has a window 18. The purpose of the window is to display a forwarding address on the front face of an invoice placed within the pocket 17. The window has top and bottom edges 19 and 19*b*. The edges 19 and 19*b* are long enough to display the length of a normal address label. For example, edges 19 and 19*b* are each about three inches long. The bottom edge 19 is spaced from the bottom edge of the pocket 3 by a distance that allows the display of a normal mailing label. For example, the lower bottom edge l9 is an inch and a half from the bottom edge of the front face 3.

The window has first and second side edges 18 and 20. The edges 18 and 20 are long enough to display the height of a normal address label. For example, edges 18 and 20 are each one inch tall. The side edge 20 is spaced from the side edge of the pocket 6 by a distance that allows the display of a normal mailing label. For example, the side edge 20 is an inch and a quarter from the side of the pocket 6.

As illustrated, the corners of the window 18 are chamfered. The radius of the chamfer is small enough so that the text in the label is not obscured. For example, the chamfer radius is one quarter of an inch. However, it is considered that the corners could be squared.

Figure 2:
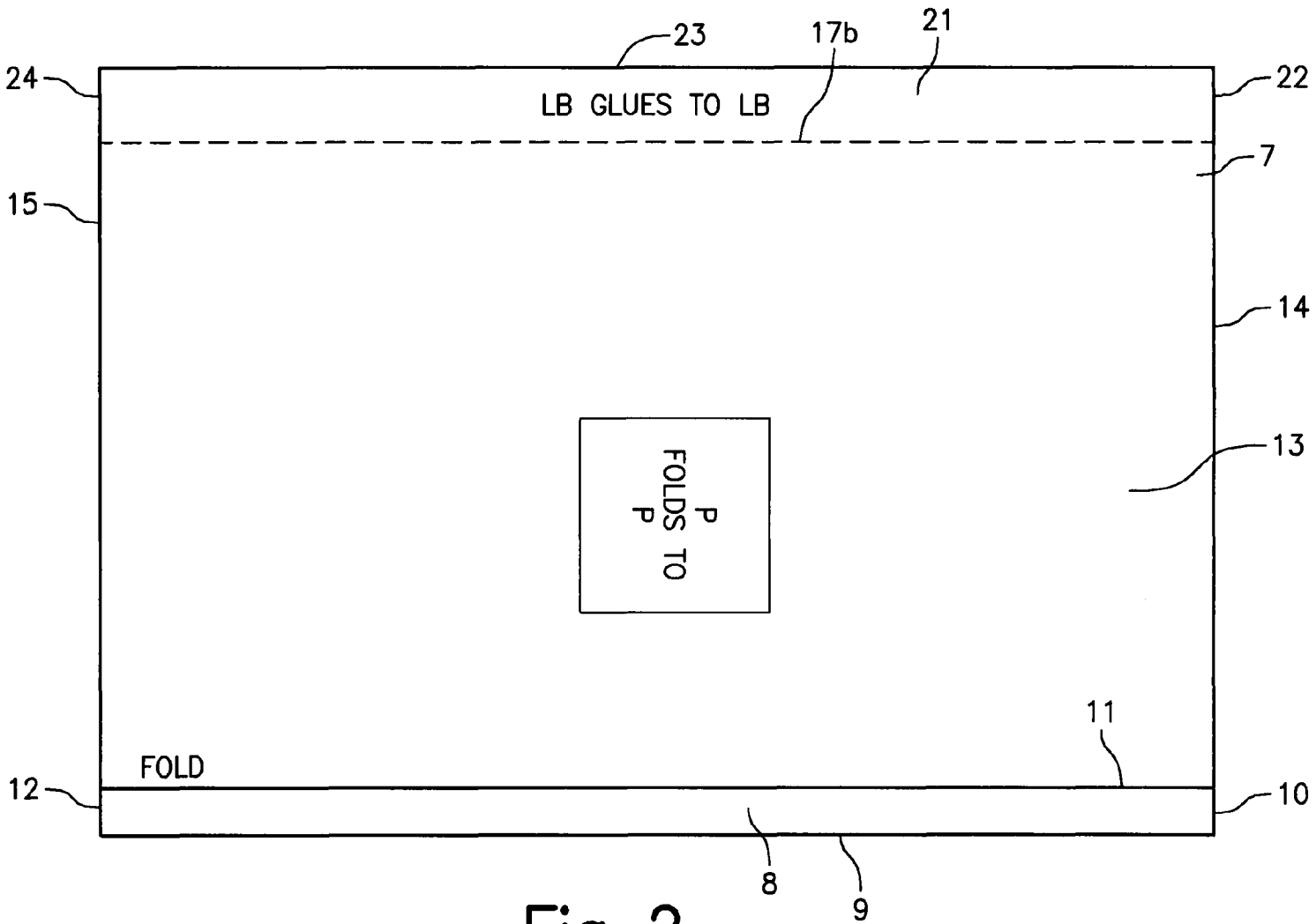
FIG. 2 is a rear view of an inner leaf of the mailer.

Referring to FIGS. 1 and 2, the mailer has a first inner leaf 7 that is adjacent to the front leaf 2. The inner leaf 7 is used to form the back face of the pocket 17 and to extend the front surface of the mailer 1, away from edge 3, to be at least as long as a return envelope or buck slip stored within the mailer 1.

The inner leaf 7 is made of paper having a weight that enables the paper to withstand commonly applied stress during the processing and mailing of the mailer 1. The weight of the inner leaf 7 also allows the mailer 1 to maintain a first class mail rating when the mailer is filled with a return envelope and a plurality of buck slips.

The first inner leaf 2 has a bottom segment 8. The bottom segment receives an adhesive for connecting the internal leaf 7 to the rear leaf 25 of the mailer 1. The adhesive is spread over the entire surface area of the bottom segment 8 and can be a press-on adhesive or an adhesive that reacts to heating.

The bottom segment 8 has a bottom edge 9 and a top edge 11. The bottom edge 9 and top edge 11 are parallel to each other, where each edge 9 and 11 has a length that is the same as the bottom edge 3 of the pocket 17. This ensures that the bottom segment 8 will not extend beyond the side edges of the pocket 17.

The top edge 11 is a fold edge that is co-incident with the bottom edge 3 of the pocket 17 when the inner leaf 7 is adhered to the mailer 1. The inner leaf 7 is folded about the fold edge 11, placing the bottom segment of the inner leaf 8 against the rear leaf 25 and allowing the inner leaf 8 to mate against the pocket 17, forming the back leaf of the pocket 17.

Adjacent to and perpendicular with the bottom and top edges 9 and 11 are first and second side edges 10 and 12. Upon sealing the bottom segment 8 against the rear leaf 25, the side edges 10 and 12 are parallel to the first and second side edges 4 and 6, respectively, of the pocket 17. The geometrical similarities between the pocket 17 and the inner leaf 7 allow proper alignment between the leafs.

The length of side edges 10 and 12 provides the bottom segment 8 with a surface area that enables a permanent hold against the rear leaf 25 of the mailer 1 following the application of an adhesive. For example, the length of the side edges 10 and 12 are each one quarter of an inch.

Referring to FIGS. 1 and 2, the inner leaf 7 has a middle segment 13. The middle segment 13 has parallel first and second side edges 14 and 15. The side edges 14 and 15 are co-linear to the first and second edges 6 and 4, respectively, of the pocket 17. The first and second side edges 14 and 15 are each at least as long as an adjacent edge of a return envelope or buck slip stored within the mailer 1. The edges 14 and 15 are shorter than top and bottom edges 9 and 17*b*. The proportionality between the lengths of edges 14 and 15 and edges 9 and 17*b* is equivalent to the proportionality of the edges of a standard rectangular mailer. For example, the first and second side edges 14 and 15 are both about four inches long.

The middle segment has a top edge 17*b*. The top edge 17*b* and top edge 11 of the bottom segment are designed to fit against opposing edges of a return mailer or buck slip stored within the mailer 1. For example, the top edge 17*b* is parallel to the top edge 11 of the bottom segment 8 and the same length as the top leaf 11 of the bottom segment. Accordingly, the edges 11, 13, 15 and 17*b* of the middle segment form a rectangular surface for holding a rectangular return mailer or buck slip within the mailer 1.

In use, the inner leaf 7 is sealed against the pocket 17. Specifically, the bottom segment 8 is sealed against the return leaf 25 so that the top edge 11 is sealed against the bottom edge 3. Placing the bottom segment 8 against the rear leaf 25 maximizes the storage in pocket 17. The first and second sides of the inner leaf 14 and 15 are sealed against the first and second side edges 4 and 6 of the pocket 17. The thickness of the glue on the first and second sides 14, and 16 is enough to secure the inner leaf 7 against the pocket 17. For example, the thickness is one quarter of an inch.

Upon sealing the inner leaf 7 against the pocket 17, the top edge 5 of the pocket 17 remains unsealed. The opening between the two faces defines the enclosure for the pocket 17 for inserting papers such as letters, invoices, promotions, etc.

Referring to FIGS. 1 and 2, the inner leaf 7 has a tear away segment 21. The tear segment 21 is capable of receiving glue and being pressed against the mailer 1 for sealing the segment 21 against the mailer 1. The tear away segment 21 is capable of being torn away by the recipient for opening the mailer 1.

The top segment 21 and middle segment 13 are connected by a perforated line. The perforated line is the top edge of the middle segment 17*b*. The perforations are designed to enable a recipient to tear away the segment 21 without tearing the remainder of the inner leaf 7. The perforations are also designed to handle the stress of normal mailing without tearing.

The top segment 21 has first and second side edges 22 and 24. The first and second side edges 22 and 24 each extend linearly, the same distance, from the first and second side edges 14 and 15 of the middle segment 13, away from the edge 11 of the middle segment 13. The distance that first and second side edges 22 and 24 extend provides a surface area for applying sealant to secure the inner leaf 7 against the mailer 1. For example, the length of the first and second side edges 22 and 24 are both a quarter of an inch.

Adjacent to and perpendicular with the first and second side edges 22 and 24 is top edge 23. The top edge spans the length of the inner leaf 7 and is, for example, about seven and a quarter inches long. The top edge 23 completes the rectangular surface of the top segment 21, enabling the top segment 21 to receive the sealant and seal the inner leaf 7 within the closed mailer 1.

Turning to FIG. 3, the mailer 1 has a rear leaf 25. The rear leaf 25 is continuous with the bottom edge 3 of the pocket 17. The rear leaf 25 has first and second side edges 26 and 27. The first and second side edges 26 and 27 are shaped to fit against the adjacent edge of the return envelope or buck slip. Accordingly, the first and second side edges 26 and 27 are adjacent to and co-linear with the first and second side edges of the inner leaf 15 and 14.

Complementing both the first and second edges 26, and 27, and opposing the bottom edge 3, is the top edge 28 of the rear leaf 25. The top edge 28 is shaped to fit against the adjacent edge of the return envelope or buck slip. The top edge 28 is adjacent to and co-linear with the top edge of the inner leaf 17*b*. The top edge 28 is parallel with the bottom edge 3 and perpendicular to the first and second side edges 26 and 27 of the rear leaf 25.

According to the illustration, the rear leaf 25 is a rectangle, having the same dimensions as the middle segment of the inner leaf 13. The rear leaf has a surface area that is at least as large as a return mailer and buck slip stored within the mailer 1.

The rear leaf 25 has a tear away segment 28*b*. The tear segment 28*b* is capable of receiving glue and being pressed against the tear away segment 21 of the inner leaf 7 for sealing the mailer 1. The tear away segment 28*b* is capable of being torn away by the recipient for separating the inner leaf 7 and rear leaf 25 so as to open the mailer 1.

The tear away segment 28*b* and rear leaf 25 are connected by a perforated line. The perforated line is the top edge of the rear leaf 28. The perforations are designed to enable a recipient to tear away the segments 28*b* and 21 concurrently without tearing the remainder of the inner leaf 7 or the rear leaf 25. The perforations are also designed to handle the stress of normal mailing without tearing.

The tear away segment 28*b* has first and second side edges 28*c* and 28*d*. The first and second side edges 28*c* and 28*d* each extend linearly, the same distance, from the first and second side edges 26 and 27 of the rear leaf 25, away from the bottom edge 3. The distance that first and second side edges 28*c* and 28*d* extend is the same distance that edges 22 and 24 extend from the top edge 17*b* of the inner leaf. The surface created from the edges 28*c* and 28*c* provides a surface area for applying sealant to secure the rear leaf 25 against the inner leaf 7 of the mailer 1.

Adjacent to and perpendicular with the first and second side edges 28*c* and 28*d* is top edge 28*e*. The top edge spans the length of the top edge 23 of the tear off section. 21 of the inner leaf 7. The top edge 28*e* completes the rectangular surface of the top segment 28*b*, enabling the top segment 28*b* to receive the sealant and seal against the top segment 21 of the inner leaf 7 to close the mailer 1.

Figure 4:
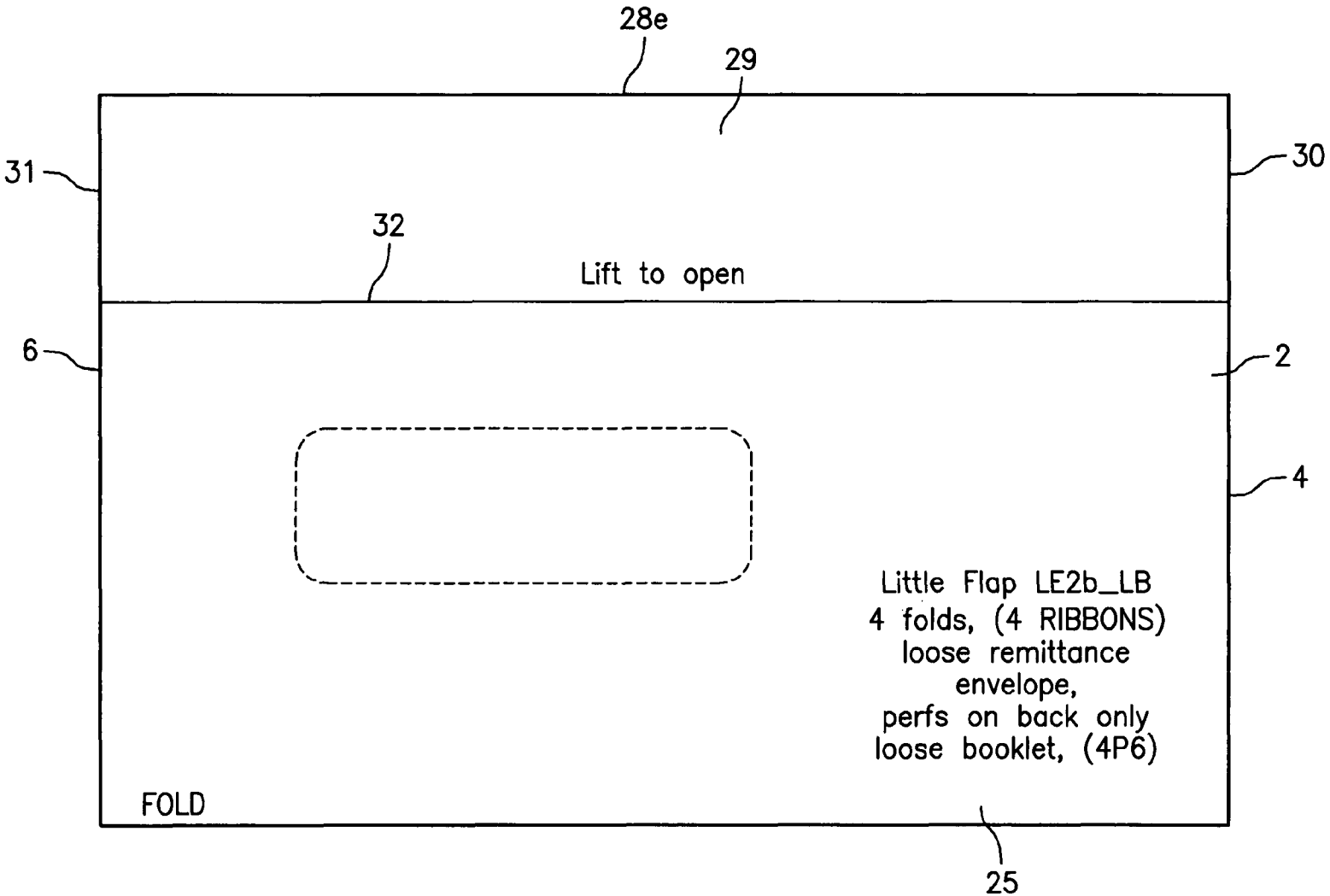
FIG. 4 is a front view of the front leaf and pocket and lid of the mailer with the lid sealed against the pocket.

Turning now to FIGS. 3 and 4, the mailer has a third leaf 29. The third leaf forms 29 an opening flap for the mailer 1. The purpose of the opening flap 29 is to allow the user to open the mailer 1 in two steps. The first step is to peel off a sealant on the flap to expose the free edge 5 of the pocket 17 (FIG. 1). The second step is to tear the tear off sections 21 and 28*b* from the inner and rear leafs 7 and 25, from the mailer 1 thereby opening the mailer 1.

The opening flap 29 shares the top edge 28*e* with the rear leaf 25. Accordingly, the opening flap 29 is continuous with and comprises the same material as the rear leaf 25 and the pocket 17.

The opening flap 29 has parallel first and second side edges 30 and 31. The first and second side edges 30 and 31 are collinear with the first and second side edges 26, and 27 of the rear leaf 25. Upon placement of the lid 29 against the pocket 17, the first and second side edges 30 and 31 are collinear with the first and second side edges of the pocket 4 and 6.

Upon placement of the lid 29 against the pocket 17, the first and second side edges 30 and 31 extend downwardly so as to cover the opening edge 5 of the pocket 17. The first and second edge 30 and 31 extends past the opening of the pocket 17 to the extent that an applied sealant will prevent the flap 29 from opening in transit. As an illustration, the first and second side edges 30 and 31 extend one quarter of an inch past the top edge of the front leaf 5.

Between the first and second side edges 30 and 31 is a bottom edge 32 of the opening flap 29. The bottom edge is linear, perpendicular to the first and second edges 30 and 31, and parallel to the top edge 28*e*. The length and shape of the bottom edge 32 is the same as the top edge 28*e* to provide the opening flap 29 with a rectangular surface area.

Figure 5:
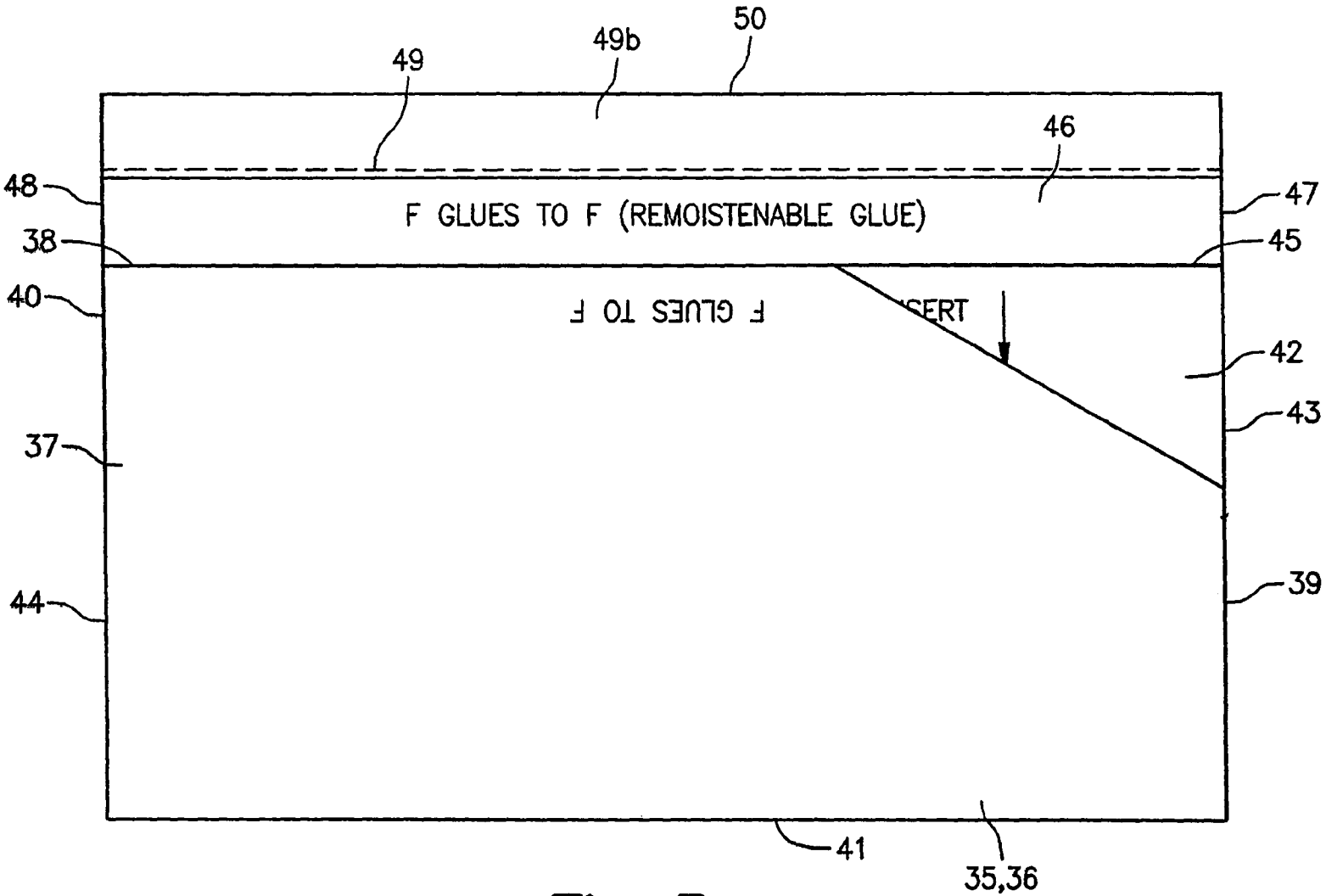
FIG. 5 is a front view of a return mailer.

Referring to FIG. 5, the top segment of the inner leaf 21 is sealed to the inner surface of the opening flap 33. Upon the pealing of opening flap 29 from the pocket 5, the inner leaf 7 remains sealed to the opening flap 29. It is not until the opening flap 29 is torn from the mailer 1 that the top segment of the inner leaf 7 becomes detached from the mailer so that the mailer can be opened.

The flap has no perforations. Accordingly, the flap is capable of being opened without tearing the tear off sections 21 and 28*b* from the mailer. This allows the recipient to open the pocket 17 and review the contents of the pocket without immediately having to review the buck slip or handle the return mailer within the mailer 1. This is appropriate because the contents of the pocket 17 are often very important compared to the contents of the buck slip and consist of, for example, a bill. Once the recipient has reviewed the contents of the pocket 17, the recipient can tear off the sections 21 and 28*b* from the mailer 1 to separate the inner leaf 7 from the rear leaf 25 and open the mailer.

Turning now to FIG. 5, a return envelope 35 is disclosed. The return envelope 35 has a pocket 36 that is capable of receiving the invoice that was included in the front pocket 17. The return envelope 35 is made of paper having a weight that enables the paper to withstand commonly applied stress during the processing and mailing of the mailer 1. The return envelope 35 comprises a material that also allows the mailer 1 to be maintain a first class mail status upon being sent to the recipient.

The return envelope has a front leaf 37. The front leaf 37 has a top edge 38. The top edge 38 forms the top edge of the pocket 36. The top edge 38 is dimensioned to fit a standard invoice. For example, the top edge is about seven and a quarter inches long.

The front leaf 37 also has first and second side edges 39 and 40. The first and second side edges 39 and 40 are parallel to each other and perpendicular to the top edge 38. The length of each side edge 39 and 40 enables an invoice or buck slip to be placed within the pocket 36 without being folded or crushed. For example, each side edge 39 and 40 is about three and a half inches long.

The pocket 36 has a lower edge 41. The lower edge is parallel to the upper edge 38 and perpendicular to both side edges 39 and 40. The length of the front edge is the same as the length of the upper edge 38. The shape of the lower edge 41 allows the edge 41 to abut an invoice or buck slip placed inside the return envelope 35.

The shape of the front leaf of the pocket 36, as a result of the first and second side edges, 39 and 40, and the top and bottom edges 38 and 41, is rectangular. The rectangular shape is appropriate because average buck slips and invoices are printed on rectangular sheets or folded in rectangular sections.

The pocket 36 has a rear leaf 42. The rear leaf shares the lower edge 41 with the front leaf 37, so that the rear leaf 42 and the front leaf 37 are a continuous sheet of material. Forming the front and rear leafs from a single sheet of material enables the bottom edge of the pocket to be sealed by folding the sheet about the edge 41, without the need of a sealant.

The rear leaf 42 has first and second side edges 43 and 44. The first and second side edges 43 and 44 are parallel to each other, collinear with, and the same size as the first and second side edges 39 and 40 of the pocket 36.

The first and second edges 39 and 40 of the front leaf 37 are sealed against the first and second edges 43 and 44 of the rear leaf 43. The sealant is a common adhesive, such as a press on adhesive or an adhesive that is activated via heat treatment. The sealant is applied along the entire length of edges 39, 40, 43 and 44, and projects inwardly on the front and rear leafs 37 and 42 to a distance that provides a permanent seal. For example, the sealant projects one half of an inch from the outside of the pocket 36 towards the center of the pocket 36.

The rear leaf 42 has a top edge 45. The top edge 45 is parallel to the bottom edge 41 and the same length as the bottom edge. The edge 45 is also perpendicular to the side edges 43 and 44. The side edges 43 and 44, and opposing top and bottom edges 45, and 41 of the rear leaf provide the rear leaf with the same rectangular size and shape as the front leaf of the pocket 35.

It is to be appreciated that the dimensions of the pocket can be scaled to accommodate different sized buck slips or invoices, so long as the coincident edges on each face have the same dimensions and directions.

Extending from the top edge 45 of the rear leaf 42 is a lid 46 that is capable of folding against the front leaf 37 of the pocket 36 for sealing the return envelope 35. The lid 46 has first and second parallel side edges 47 and 48. The side edges 47 and 48 extend linearly from the edges 43 and 44 of the rear leaf 42 of the pocket 36.

The first and second side edges 47 and 48 are dimensioned to be long enough to provide the lid 46 with a predetermined surface area for applying a sealant. The surface area on the lid 46 enables the application of an appropriate amount of sealant to ensure that the return mailer is sealed from the recipient location to the subsequent destination. For example, the length of edges 47 and 48 is one half of an inch.

Between the first and second side edges 47 and 48 of the lid 46 is a top edge 49 of the lid 46. The top edge 49 is linear, perpendicular to the first and second edges 47 and 48, and parallel to the top edge 45 of the rear leaf 42 of the pocket 36. The length and shape of the top edge 49 is the same as the top edge 45 to provide the lid 46 with a rectangular surface area.

The sealant applied to the lid 46 is the kind that can be activated with the addition of a liquid, such as by saliva from a person sending the return envelope to the original sender. Such a sealant is known as a remoistenable sealant because it is applied to the lid 46 of the return mailer 35 prior to reaching the recipient, allowed to dry, and allowed to be wetted by the recipient for sealing against the front leaf 37 of the pocket 36.

Extending above the pocket 36, above the lid 46 of the rear leaf 42, is a tear off section 49*b*. The tear off section 49*b* connects the return mailer 35 to the tear off sections 21 and 28*b* inner leaf 7 and rear leaf 25 of the mailer 1 during transit, prior to reaching the recipient. The tear off section 49*b* is removed from the mailer by the recipient simultaneously with the tear off sections 21 and 28*b* of the inner leaf 7 and the rear leaf 25, releasing the return envelope 35 from the mailer 1.

The tear off section 49*b* has a perforated bottom edge which is the top edge of the lid 49. The perforated edge 49 is capable of being torn from the return envelope 35 by a simple twisting of the tear off section 49*b* from the rear leaf 42 of the return envelope 35 about the perforated edge 49.

In use, the return mailer 35 is sealed to the tear off section 28*b* of the rear leaf 25, between the rear leaf 25 and the inner leaf 7. When the return mailer 35 is sealed in the mailer 1, the perforated edge 49 is parallel to and coincident with the perforated edge 28 on the rear leaf 25 of the mailer 1 (FIG. 3). This orientation places the perforated edge 17*b* on the inner leaf 7 in a configuration that is parallel to and coincident with the perforated edges 49 and 28 of the return mailer 35 and rear leaf 25.

The tear off section 48 has top edge 50. The top edge is parallel to the perforated edge 49. The distance between the top edge 50 and the bottom edge 49 creates a surface area for applying the sealant that connects the tear off section 49*b* of the return envelope 35 to the tear off section 28*b* of the rear leaf 25 of the mailer 1. The surface area is large enough to ensure that the return mailer 1 remains connected to the mailer 1 while the mailer 1 is being transported to the recipient. As an example, the top edge is offset from the bottom edge by one half of an inch. This offset distance places the top edge 50 of the tear off section 49*b* of the return envelope 35 against the top edge 28*e* of the tear off section 28*b* the rear leaf 25.

In use, when a recipient of the mailer 1 tears the opening lid 29 (FIG. 3) off of the rear leaf 25 of the mailer 1, the tear off section 49*b* of the return mailer 35 is simultaneously removed from both the return envelope 35 and the mailer 1 along with the lid 29. Subsequent to this action, the return mailer 35 is freed from the mailer 1 and is capable of receiving an invoice or buck slip, of being sealed and being mailed to the address on the invoice or buck slip.

Figure 6:
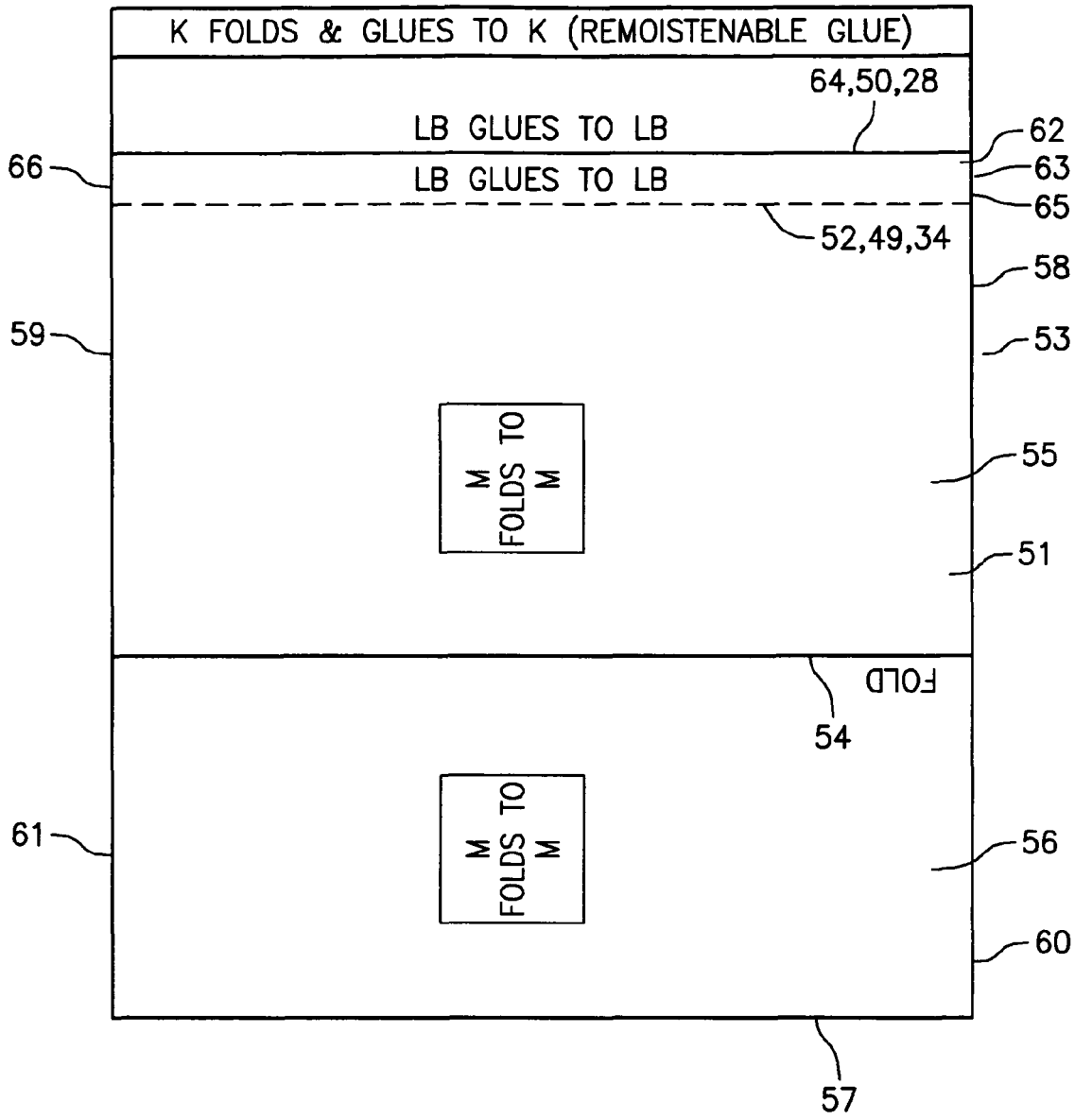
FIG. 6 is a front view of a buck slip.

Turning now to FIG. 6, a buck slip 51 is illustrated. The buck slip is used for displaying advertisements, coupons, incentives, warnings, or other types of information which is intended to be read and used by the recipient. For example, the buck slip 51 could contain a rebate for product, where the customer can return the rebate along with the invoice in the return mailer. On the other hand, the rebate might have instructions for how the customer is to proceed. For example, the rebate could state that the customer should call a toll free number to engage in a contract for a product or service.

The buck slip 51 is made of paper having a weight that enables the paper to withstand commonly applied stress during the processing and mailing of the mailer 1. The weight of the front leaf also allows the mailer 1 to maintain a first class mail rating when the mailer is filled with a return envelope and a plurality of buck slips.

The buck slip 51 has parallel top 52 and a bottom edges 54. The top and intermediate edges 52 and 54 have the same length where the length is not larger than the top edge 28 or bottom edge 3 of the rear leaf 25 (FIG. 3). This configuration allows the buck slip 1 to fit within the mailer 1 without being crushed or folded along the top edge 52 or intermediate edge 54.

The intermediate edge 54 divides the buck slip into a top portion 55 and a bottom portion 56. The intermediate edge 53 is separated from the top edge 52 by a distance that is equivalent to the distance between the top edge of the rear leaf 28 and the bottom edge of the rear leaf 3.

Perpendicular to the top edge 52 and intermediate edge 54 are first and second side edges 53 and 59 of the buck slip 51. The side edges 53 and 59 have the same length where the length is not larger than the first and second side edges 26 and 27 of the rear leaf 25. This limitation on the length prevents the edges 53 and 59 of the buck slip from being folded or crushed when the buck slip 51 is stored within the mailer 1.

Opposing the intermediate edge 54 is a bottom edge 57 of the buck slip 51. The bottom edge 57 is offset from the middle edge 54 by a distance that is not more than the distance between the middle edge 54 and the top edge 52. The limitation on the distance between the edge 54 and the edge 57 prevents the lower portion of the buck slip 56 from being crushed within the mailer 1. In FIG. 6, the bottom portion of the buck slip is offset from the top portion by about three and a half inches.

Between the middle edge 54 and the top edge 52 are side edges 60 and 61. Side edges 60 and 61 are parallel to each other and perpendicular to middle edge 54 and bottom edge 57. The length of each edge 60, and 61 is equal to the offset of between the intermediate edge 54 and the bottom edge 57. The geometry of the lower portion of the buck slip, as a result of the edges 54, 57, 60 and 61, is rectangular.

Above the top of edge 52 on the buck slip is a tear off section 62 for the buck slip 51. The tear off section 62 of the buck slip 51 has the purpose of sealing the buck slip to the mailer 1 when the mailer 1 is sent to the recipient. The sealant for the tear off section 62 of the buck slip 51 is pressure or temperature activated. The tear off section 62 has the purpose of separating the buck slip 51 from the mailer 1 upon opening the mailer 1, without further effort by the recipient of the mailer 1.

The tear off section 62 has a perforated bottom edge which is the top edge 52 of the buck slip 51. The perforated edge 52 is capable of being torn from the buck slip 51 by a simple twisting of the tear off section 62 from the buck slip 51 about the perforated edge 52.

The tear off section 62 has first and second side edges 63 and 66. The length of the first and second side edges 63 and 66 is the same as the length of the first and second side edges 22 and 24 of the tear off section 21 of the inner leaf. The length of the first and second side edges 22 and 24 provides a surface area for the placement of enough sealant to permanently connect the tear off section 62 of the buck slip 51 between the tear off section 21 of the inner face 7 and the tear off section 49*b* of the return envelope 35.

Perpendicular to the first and second side edges 63 and 66 of the tear off section 62 of the buck slip 51 is a top edge 64. The top edge 64 has a length that, along with the side edge 63, provides the surface area for applying the appropriate amount of sealant. The geometry of the tear off section, as a result of edges 52, 63, 64 and 66, is rectangular and has the same surface area as the tear off section 21 of the inner leaf 7.

In use, the tear off section 62 of the buck slip is connected between the tear off section 21 of the inner leaf 7 of the mailer 1 and the tear off section 49*b* of the return envelope 35 when the mailer 1 is mailed to the recipient. The perforated edge 52 of the buck slip 51 arranged to be parallel to and coincident with the perforated edge 17*b* of the inner leaf 7 and the perforated edge 39 of the return envelope 35. As a result, the top edge 64 of the tear off section 62 of the buck slip 51 is arranged to be parallel to and coincident with the top edge 23 of the tear off section 21 of the inner leaf 7 and the top edge 50 of the tear off section 49*b* of the return mailer 35.

In use, the customer receives the mailer 1 and pulls the opening flap 29 (FIG. 3) from the mailer 1, without tearing the perforations, to expose the contents in the front pocket 17. The customer then tears off the opening flap 29, which simultaneously tears off the tear off sections 21, 28*b*, 49*b* and 62 of the inner leaf 7, the rear leaf 25, the return mailer 35 and the buck slip 51. This process separates from the mailer the top edge 17*b* of the inner leaf 7, the top edge 28 of the rear leaf 25, the top edge 49 of the lid 35 of the return envelope 35 and the top edge 52 of the buck slip. Once the tear off sections 21, 28*b*, 49*b*, and 62 are completely disengaged from the remainder of the mailer 1, the front and rear leafs, 7 and 25, open about the bottom edge 3 of the leafs, the return envelope 35 is freed and ready to be used, and the buck slip 51 is freed and ready to be read and used.

Accordingly, a mailer has been disclosed for distributing advertisements and invoices. The mailer provides an envelope for returning the invoices and a buck slip for displaying advertisements and incentives. The buck slip and return envelope are attached to the mailer so that these papers are removed from the mailer simultaneously upon the opening of the mailer.

The present invention may be embodied in other specific. forms without departing from its spirit or essential characteristics. The described embodiments are to be considered in all respects only as illustrative and not as restrictive. The scope of the invention is, therefore, indicated by the appended claims and their combination in whole or in part rather than by the foregoing description.

All changes that come within the meaning and range of equivalency of the claims are to be embraced within their scope.

I claim:

1. A mailer comprising a front face and return envelope:

a. the front face comprising means for tearing off a section of the face; and b. the return envelope comprising means for tearing off a section of the return envelope, the return envelope means being connected to the front face means.

wherein the mailer comprises a buck slip, the buck slip comprising means for tearing off a section of the buck slip, the means for tearing off the buck slip attached to the means for tearing off the front face of the envelope, wherein the mailer further comprises a rear leaf, the rear leaf comprising means for tearing off a section of the rear leaf, the means being connected to the means for tearing off the front face of the mailer, and wherein the mailer comprises a front pocket and a lid for sealing the front pocket, the lid attached to the tear off means on the rear face of the mailer.

2. A mailer comprising a front leaf, a rear leaf, and a separate and discrete return envelope that is not a part of the rear leaf, wherein:

a. the rear leaf comprises a first tear off section, the first tear off section being connected to the mailer with a perforation line; and b. the return envelope comprises a second tear off section, the second tear off section being connected to the return envelope with a perforation line, wherein:

i. the second tear off section of the return envelope is connected to the first tear off section of the rear leaf by a sealant; and ii. the second tear off section of the return envelope is capable of being removed from the mailer simultaneously with the first tear off section of the rear leaf so that the return envelope is disconnected from the mailer;

wherein the front leaf comprises a front pocket, the front pocket comprising a front face comprising the front leaf and a back face comprising an inner leaf, wherein a bottom edge of the front face and the back face of the front pocket is free from sealant.

3. The mailer of claim 2, further comprising a buck slip, the buck slip comprising a third tear off section connected to the buck slip with a perforated line, wherein:

a. the third tear off section of the buck slip is connected to the second tear off section of the return envelope; and b. the tear off section of the buck slip is capable of being removed from the buck slip simultaneously with the first tear off section of the rear leaf so that the buck slip is disconnected from the mailer.

4. The mailer of claim 3, further comprising a front pocket, the front pocket comprising a front face comprising the front leaf, a back face comprising an inner leaf, and a sealant for sealing side edges of each leaf.

5. The mailer of claim 2, wherein the return envelope comprises front and back leaves and a sealant for sealing side edges of each leaf.

6. The mailer of claim 5, wherein a bottom edge of the front leaf and the rear leaf of the return envelope is free from sealant.

7. A mailer comprising a front face and a return envelope:

a. the front face comprising a tear off section, the section connected to the mailer with a perforation line; and b. the return envelope comprising a tear off section, the section connected to the return envelope with a perforation line, wherein: the tear off section of the return envelope is connected to the tear off section of the front face; and the tear off section of the return envelope is capable of being removed from the mailer simultaneously with the tear off section of the front face so that the return envelope is disconnected from the mailer;

wherein the mailer further comprises a buck slip, the buck slip comprising a tear off section connected to the buck slip with a perforated line, wherein the tear off section of the buck slip is connected to the tear off section of the return envelope, and the tear off section of the buck slip is capable of being removed from the buck slip simultaneously with the tear off section of the front face so that the buck slip is disconnected from the mailer, wherein the front face comprises a front pocket, the front pocket having a front and back leaf, wherein the bottom edge of the front leaf and the back leaf of the front pocket is free from sealant, wherein side edges of the front pocket of the front leaf and back leaf comprise a sealant for sealing the side edges, wherein the return envelope comprises front and back leaves and a sealant for sealing side edges of each leaf, wherein the bottom edge of the front leaf and the rear leaf of the return envelope is free from sealant, and wherein the mailer comprises a front flap, said front flap being capable of sealing the front pocket, and said front flap being removable from said mailer simultaneously with the tear off section of the front pocket.

8. The mailer of claim 7, wherein the buck slip comprises at least two leaves and at least one fold line for connecting the two leaves.

9. The mailer of claim 8, where the front pocket comprises a window for viewing a mailing address.

10. The mailer of claim 9, wherein the mailer comprises a front leaf and a rear leaf, side edges of the front and rear leaves being free from sealant.

11. The mailer of claim 10, wherein the rear leaf of the mailer comprises a tear off section connected to the rear leaf with a perforation line, the tear off section being connected to the opening flap, wherein the tear off section of the rear leaf is capable of being removed from the mailer and from the rear leaf simultaneously with the tear off section of the front pocket so that the mailer is opened.

12. The mailer of claim 11, wherein the return envelope comprises a lid, the lid capable of being pressed against the front of the return envelope, the envelope comprising a sealant on the surface of the lid, the sealant capable of sealing the lid against the return envelope upon the pressing of the lid against the envelope.

* * * * *